US008261547B2

(12) United States Patent
Giesen

(10) Patent No.: US 8,261,547 B2
(45) Date of Patent: Sep. 11, 2012

(54) PNEUMATIC ACTUATOR

(75) Inventor: Norbert Giesen, Geldern (DE)

(73) Assignee: Norgren GmbH, Alpen (DE)

( * ) Notice: Subject to any disclaimer, the term of this patent is extended or adjusted under 35 U.S.C. 154(b) by 889 days.

(21) Appl. No.: 12/374,184

(22) PCT Filed: Jul. 31, 2006

(86) PCT No.: PCT/EP2006/007567

§ 371 (c)(1),
(2), (4) Date: Jan. 16, 2009

(87) PCT Pub. No.: WO2008/014799

PCT Pub. Date: Feb. 7, 2008

(65) Prior Publication Data

US 2009/0282971 A1 Nov. 19, 2009

(51) Int. Cl.
*F15B 11/032* (2006.01)
*B25B 5/06* (2006.01)

(52) U.S. Cl. ..... 60/567; 60/563

(58) Field of Classification Search ..... 60/560, 60/563, 565, 567
See application file for complete search history.

(56) References Cited

U.S. PATENT DOCUMENTS

| | | | | |
|---|---|---|---|---|
| 3,991,661 | A | 11/1976 | Mocha | |
| 4,072,013 | A * | 2/1978 | Barbareschi | 60/563 |
| 4,471,614 | A | 9/1984 | Hart | |
| 5,042,253 | A * | 8/1991 | Kataoka | 60/560 |
| 5,125,326 | A | 6/1992 | Sarcona | |
| 5,165,322 | A | 11/1992 | Moody | |
| 5,377,488 | A | 1/1995 | Malina | |
| 5,381,661 | A | 1/1995 | Malina | |
| 5,836,161 | A | 11/1998 | Malina | |
| 5,943,862 | A | 8/1999 | Malina | |

FOREIGN PATENT DOCUMENTS

| | | | |
|---|---|---|---|
| DE | 2505553 | A1 | 4/1976 |
| DE | 19534380 | A1 | 3/1997 |
| JP | 4627692 | | 9/1971 |
| JP | 4995394 | | 9/1974 |
| JP | 57179404 | A | 11/1982 |
| JP | 60256608 | A | 12/1985 |

* cited by examiner

*Primary Examiner* — Thomas E Lazo
(74) *Attorney, Agent, or Firm* — The Ollila Law Group LLC

(57) ABSTRACT

A pneumatic actuator (100) is provided according to the invention. The actuator (100) comprises an actuator body (102) and a piston rod (108) extending from the actuator body (102). The piston rod (108) moves over an actuation span. The actuation span comprises a first stroke span that is traversed by the piston rod (108) at a first actuation speed and a second stroke span that is traversed at a second actuation speed that is substantially slower than the first actuation speed.

35 Claims, 5 Drawing Sheets

PNEUMATIC ACTUATOR

BACKGROUND OF THE INVENTION

1. Field of the Invention

The present invention relates to an actuator, and more particularly, to a pneumatic actuator.

2. Statement of the Problem

An actuator is a device that performs some mechanical action. One actuator is a piston, wherein a plunger of the piston moves in a reciprocating manner. The plunger can therefore be connected to some manner of work piece or other mechanical system.

In some actuator applications, it is desirable to have more than one actuation speed and/or more than one actuation force over the range of motion of the actuator. For example, in a spot welder machine, a pair of welding jaws must be brought together onto a work piece during a welding operation. The jaws must clamp onto the work piece with a desired force. Therefore, at the end of a clamping motion range, a relatively high actuation force must be provided to the welding jaws. However, an actuator that provides a high level of force typically provides a relatively small range of actuation travel. This can be a problem where the jaws of the spot welder machine must open wide in order to be positioned on the work piece. Therefore, a jaw actuator of the spot welder machine needs to move relatively rapidly during a first actuation span and a large force is not required. During the second actuation span, the jaws need to move only a small distance, but must be able to provide a large clamping force.

SUMMARY OF THE INVENTION

A pneumatic actuator is provided according to an embodiment of the invention. The actuator comprises an actuator body and a piston rod extending from the actuator body. The piston rod moves over an actuation span. The actuation span comprises a first stroke span that is traversed by the piston rod at a first actuation speed and a second stroke span that is traversed at a second actuation speed that is substantially slower than the first actuation speed.

A pneumatic actuator is provided according to an embodiment of the invention. The actuator comprises an actuator body and a piston rod extending from the actuator body. The piston rod moves over an actuation span. The actuation span comprises a first stroke span that is traversed by the piston rod using a first actuation force and a second stroke span that is traversed using a second actuation force that is substantially greater than the first actuation force.

A pneumatic actuator is provided according to an embodiment of the invention. The actuator comprises an actuator body including an outer shell and an inner shell, a piston slidably located in a piston chamber in the inner shell, and a ram slidably located in the outer shell and configured to move at least partially into the inner shell. The actuator further comprises a movable ring slidably located in a ring chamber located between the inner shell and the outer shell and a hydraulic fluid located in a region between the ram, the piston, and the movable ring. Upward movement of the movable ring forces the piston downward over a first stroke span due to movement of a first volume of the hydraulic fluid from the ring chamber into the piston chamber. Downward movement of the ram forces a second volume of the hydraulic fluid down into the piston chamber, wherein the downward movement of the ram forces the piston downward over a second stroke span.

ASPECTS OF THE INVENTION

In one embodiment of the actuator, the second stroke span is substantially smaller in length that the first stroke span.

In another embodiment of the actuator, the first stroke span is traversed by the piston rod at a first actuation speed and the second stroke span is traversed by the piston rod at a second actuation speed that is substantially slower than the first actuation speed.

In yet another embodiment of the actuator, the first stroke span is traversed by the piston rod using a first actuation force and the second stroke span is traversed by the piston rod using a second actuation force that is substantially greater than the first actuation force.

In yet another embodiment of the actuator, the second stroke span occurs at any point along the actuation span.

In yet another embodiment of the actuator, the second stroke span is generated by a force multiplier of the actuator.

In yet another embodiment of the actuator, the actuator further comprises a plurality of pneumatic ports in the actuator body.

In yet another embodiment of the actuator, the actuator further comprises a port A that introduces pressurized gas into the ring chamber below the movable ring.

In yet another embodiment of the actuator, the actuator further comprises a port B that introduces pressurized gas into the ram chamber below the ram.

In yet another embodiment of the actuator, the actuator further comprises a port C that introduces pressurized gas into the ram chamber above the ram.

In yet another embodiment of the actuator, the actuator further comprises a port D that introduces pressurized gas into the piston chamber below the piston.

In yet another embodiment of the actuator, the actuator further comprises a piston ring located in the outer shell and below the piston, with the piston ring slidably located in the outer shell and being configured to sealingly slide on the piston rod, wherein a port E is located below the piston ring and the piston ring moves up and pushes the piston upward when pressurized gas is introduced into port E.

In yet another embodiment of the actuator, the actuator further comprises one or more hydraulic fluid passages extending between the ram throat and the ring chamber.

DESCRIPTION OF THE DRAWINGS

The same reference number represents the same element on all drawings. It should be understood that the drawings are not necessarily to scale.

DETAILED DESCRIPTION OF THE INVENTION

FIGS. 1-5 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
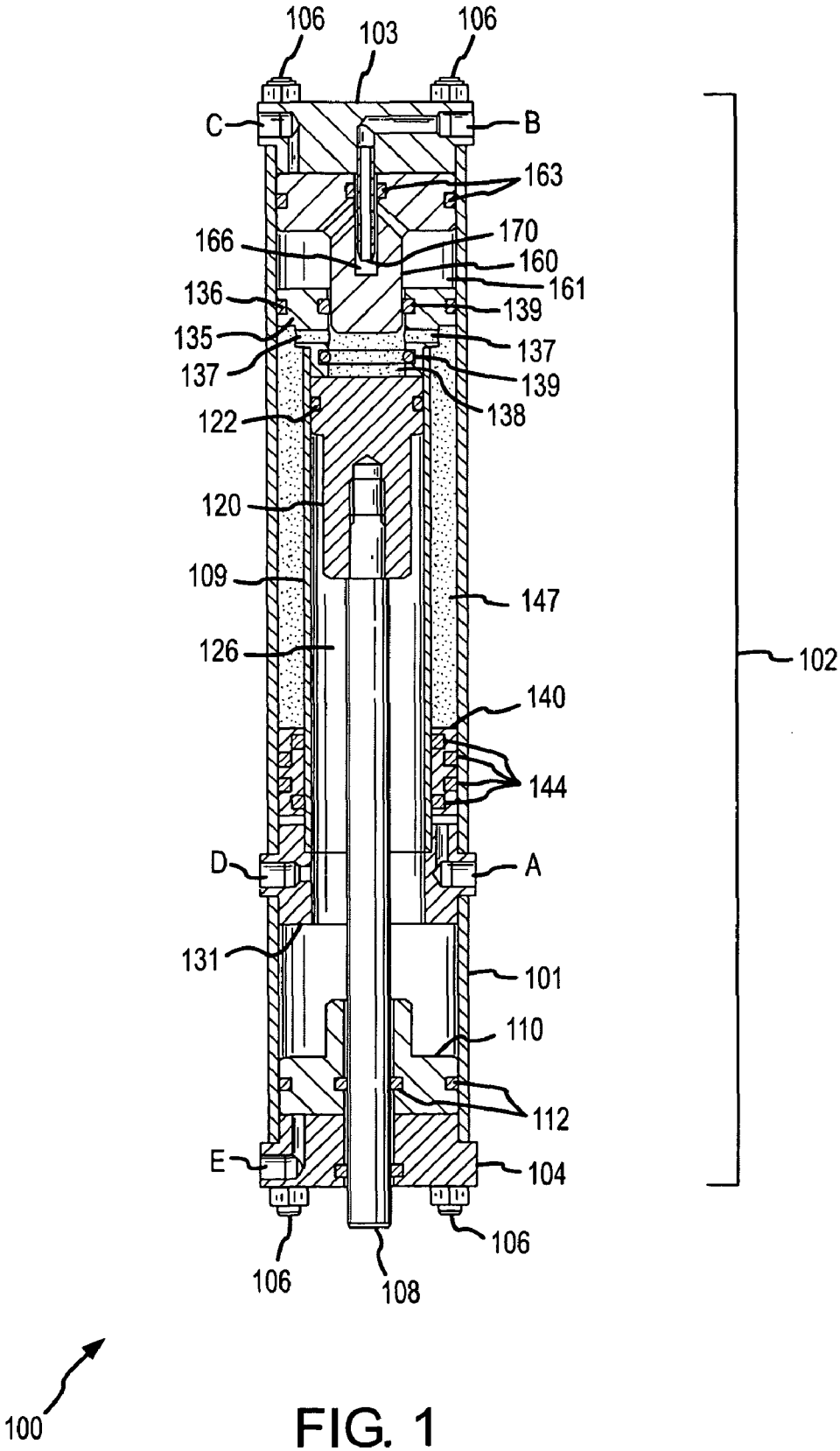
FIG. 1 shows a pneumatic actuator according to an embodiment of the invention.

FIG. 1 shows a pneumatic actuator 100 according to an embodiment of the invention. The figure comprises a section view approximately along a center of the actuator 100, showing internal components. The actuator 100 includes an actuator body 102 and a piston rod 108 extending out of the actuator body 102. The actuator body 102 in one embodiment comprises an outer shell 101, a top plug 103, a bottom plug 104, and one or more fasteners 106 that hold the top plug 103 and the bottom plug 104 in the outer shell 101. The piston rod 108 movably extends from the bottom plug 104, with the piston rod 108 configured to be extended and retracted. The extension and retraction of the piston rod 108 can perform mechanical work and the piston rod 108 can be coupled to any manner of mechanical device. The pneumatic actuator 100 can extend and retract the piston rod 108 according to selective introduction of a pressurized gas, such as pressurized air.

Figure 2A:
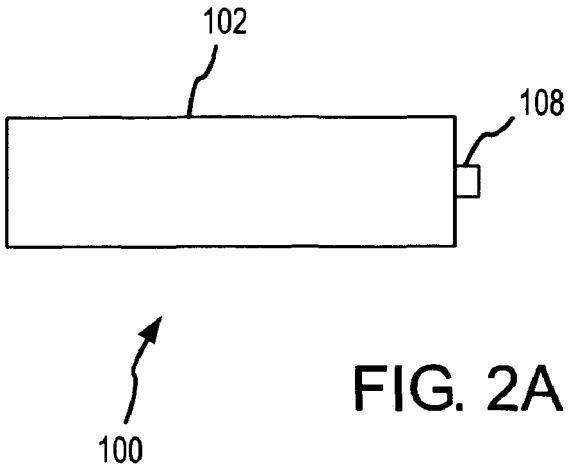
FIGS. 2A-2C show the actuator in different extension positions.
Figure 2B:
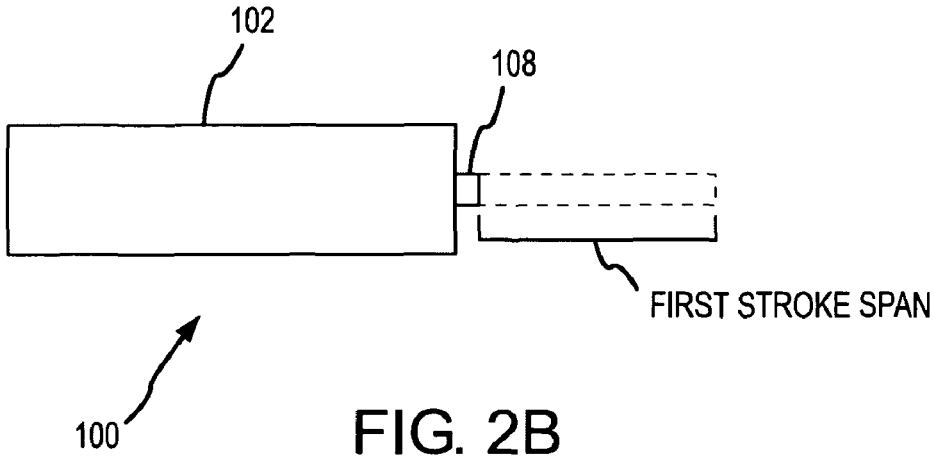
Figure 2C:
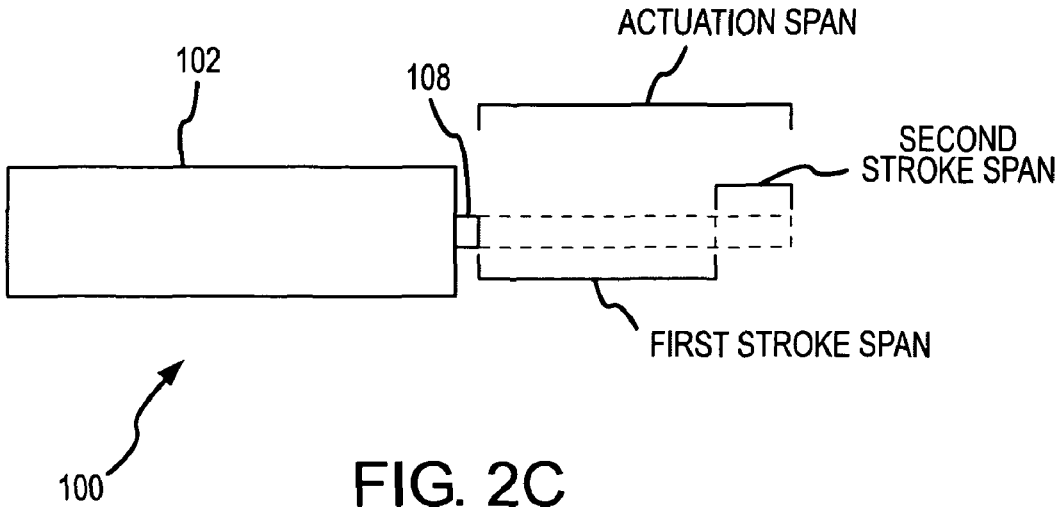

FIGS. 2A-2C show the actuator 100 in different extension positions. The actuator 100 in one embodiment comprises a three-position actuator. In FIG. 2A, the piston rod 108 is fully retracted. In FIG. 2B, the piston rod 108 is extended to a first stroke span. In FIG. 2C, the piston rod 108 is fully extended over an actuation (i.e., full stroke) span. The actuation span therefore comprises the first stroke span plus a second stroke span. The second stroke span can differ from the first stroke span. For example, the second stroke span can be substantially smaller in length than the first stroke span. This is desirable when actuating a mechanical device that requires a large actuation span followed by a small actuation span, or vice versa.

The first stroke span can be traversed at a first actuation speed and the second stroke span can be traversed at a second actuation speed. In one embodiment, the second actuation speed is substantially slower than the first actuation speed.

The first stroke span can be traversed using a first actuation force and the second stroke span can be traversed using a second actuation force. In one embodiment, the second actuation force is substantially greater than the first actuation force.

The actuator 100 in one embodiment includes a force amplifier. In one embodiment, the actuator 100 includes a hydro-pneumatic force amplifier. The force amplifier can provide a force greater than a force generated by a supplied pneumatic pressure alone. The actuator 100 in one embodiment can provide a force amplifier at any point in the overall actuation span. The force amplifier can be actuated at a midpoint of the actuation span or can be actuated before or after the midpoint.

Referring again to FIG. 1, the actuator 100 further includes a piston 120 that reciprocally moves in a piston chamber 126. The piston 120 is connected to and moves the piston rod 108.

The actuator 100 further includes an inner shell 109, a lower inner plug 131, and an upper inner plug 135. The inner shell 109 forms the piston chamber 126. The lower inner plug 131 is located at a bottom region of the piston chamber 126 and the upper inner plug 135 is located at a top region of the piston chamber 126. In addition, the lower inner plug 131 and the upper inner plug 135 hold the inner shell 109 substantially in position within the outer shell 101. In one embodiment, the inner shell 109 is substantially coaxial with the outer shell 101. The upper inner plug 135 includes an upper inner plug seal(s) 136 that substantially seal the upper inner plug 135 to the outer shell 101. In addition, the upper inner plug 135 includes hydraulic fluid passages 137, a ram throat 138, and ram throat seals 139. The ram throat 138 receives a ram 160, with the ram throat seals 139 sealing the ram 138 to the upper inner plug 135. As a consequence, the ram 138 blocks the ram throat 138 and can move reciprocally up and down in the ram throat 138.

The actuator 100 further includes a piston ring 110. The piston ring 110 can include piston ring seals 112. The piston ring 110 can move with respect to the outer shell 101 and can move with respect to the piston rod 108. The piston ring 110 can move under influence of pressurized gas above and below the piston ring 110. The pressurized gas can be introduced and exhausted from above and below the piston ring 110 by port D and port E, respectively.

The actuator 100 further includes a movable ring 140 located in a ring chamber 147 formed between the inner shell 109 and the outer shell 102. The upper side of the movable ring 140 contacts a hydraulic fluid, which is also present in the piston chamber 126 above the piston 120. The movable ring 140 is configured to move reciprocally up and down between the outer shell 101 and the inner shell 109 in response to gas introduced and exhausted by port A. The movable ring 140 can include movable ring seals 144. The movable ring seals 144 substantially seal the movable ring 140 to the outer shell 101. In addition, the movable ring seals 144 substantially seal the movable ring 140 to the inner shell 109.

The actuator 100 further includes the ram 160. The ram 160 moves reciprocally up and down in a ram chamber 161. The ram 160 includes ram seals 163, a ram conduit(s) 163, and a ram filling cavity 166. The ram filling cavity 166 is fed pressurized gas by a pipe 170 that extends from the top plug 103 and that is connected to port B. The gas is transferred to a portion of the ram chamber 161 below the ram 160, with the gas traveling through the ram conduit(s) 163 to the portion of the ram chamber 161. In addition, the ram 160 is in communication with port C. As a result, the ram 160 can be moved down by introduction of pressurized gas into port C and can be moved up by introduction of pressurized gas into port B.

Upward movement of the movable ring 140 forces the piston 120 downward over a first stroke span due to movement of a first volume of the hydraulic fluid from the ring chamber 147 into the piston chamber 126. Downward movement of the ram 160 forces a second volume of the hydraulic fluid down into the piston chamber 126, wherein the downward movement of the ram 160 forces the piston 120 downward over a second stroke span.

The figure shows the actuator 100 in a fully retracted position, where the piston rod 108 is fully retracted within the actuator 100. Pressurized gas can be supplied into port D to move the piston 120 to (and hold the piston 120 in) the fully retracted position. Correspondingly, port A, port B, and port C are released in order to allow the piston 120 and the ram 160 to move to fully retracted upward positions. As the piston 120 is moved upwards, the hydraulic fluid above the piston 120 is moved out of the piston chamber 126 and is forced into the chamber between the outer shell 101 and the inner shell 109, pushing the movable ring 140 fully downward. As a result, gas is forced out of port A. In addition, port C is released and the gas between the ram 160 and the top plug 103 is not held. As a result, the upward movement of the piston 120 causes the ram 160 to move fully upward.

Figure 3:
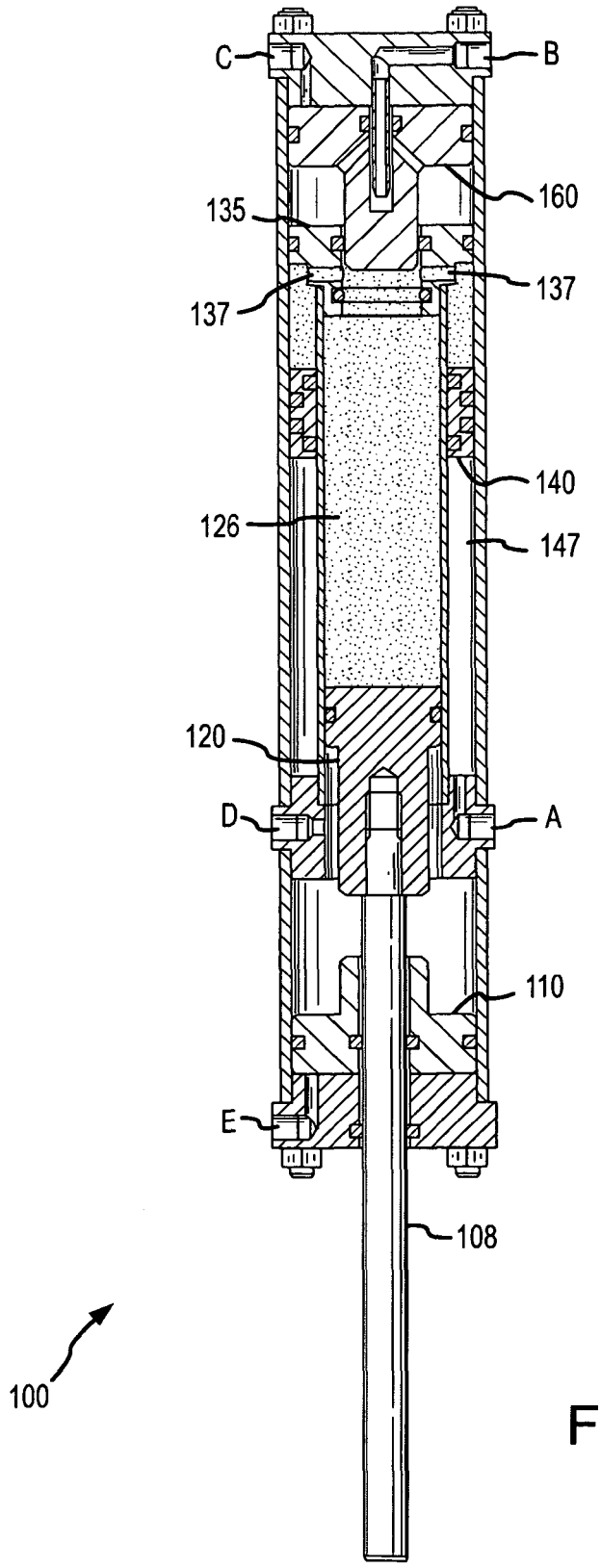
FIG. 3 shows the actuator in a partial actuation position.

FIG. 3 shows the actuator 100 in a partial actuation position. Gas has been supplied into port A, pushing the movable ring 140 upward. However, it should be noted that the movable ring 140 has not been moved to its upward limit. The upward movement of the movable ring 140 forces hydraulic fluid through the hydraulic fluid passage(s) 137 from the ring chamber 147 and into the piston chamber 126, moving the piston 120 partially down. Due to the larger diameter of the outer shell 101 and the consequent volume between the inner shell 109 and the outer shell 101, the movement of the movable ring 140 causes the piston 120 to move relatively rapidly downward (i.e., the first actuation speed). During downward movement of the piston 120, gas is released from the piston chamber 126 below the piston 120 via port D. The movement of the movable ring 140 therefore causes the piston 120 to move over the first (large) stroke span (see FIG. 2B).

Figure 4:
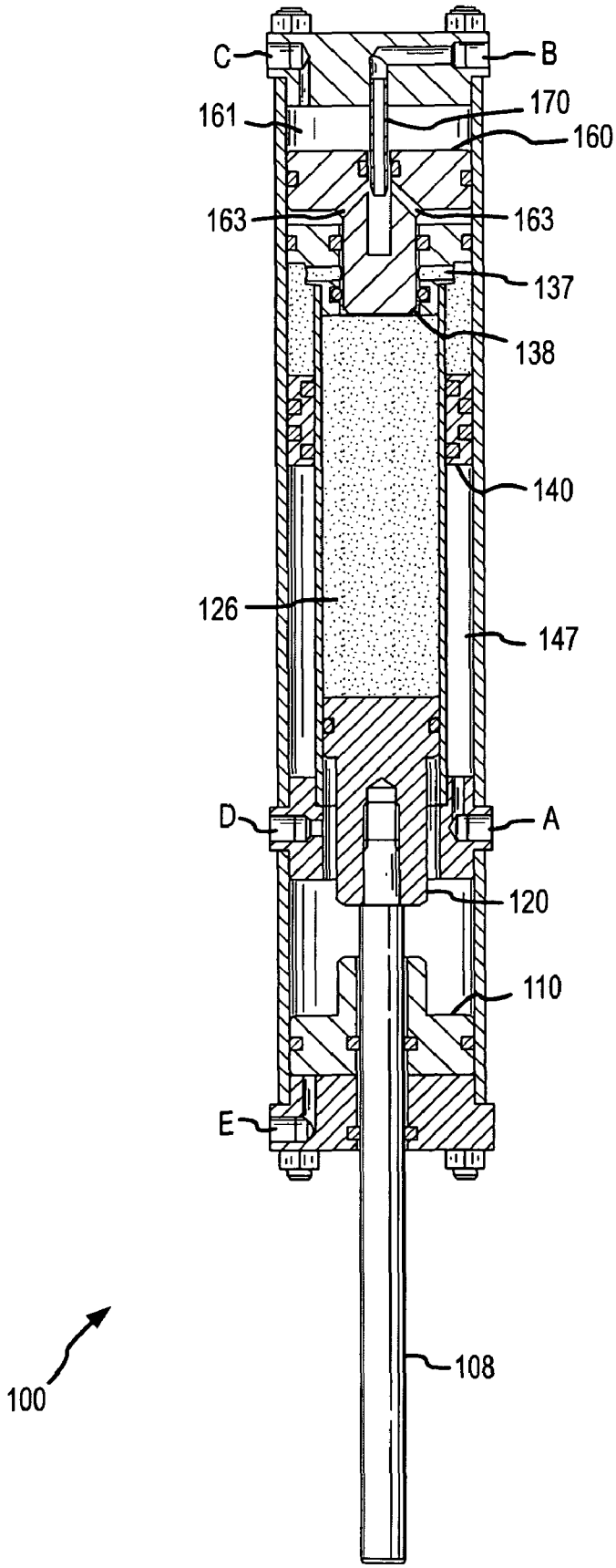
FIG. 4 shows the actuator when a force multiplier has been actuated.

FIG. 4 shows the actuator 100 when a force multiplier has been actuated. The force multiplier actuation causes the piston 120 to move over a second (small) stroke span (see FIG. 2B). However, it should be noted that the piston rod 108 is not fully extended in this figure, as the movable ring 140 is not in a fully upward position.

To actuate the force multiplier, port B is released, the pressure at port A is held, and pressurized gas is further supplied to port C. This moves the ram 160 downward in the ram chamber 161, moving the ram 160 fully into the ram throat 138. As a result, the ram 160 blocks off the hydraulic fluid passage(s) 137 and consequently seals the hydraulic fluid in the piston chamber 126. The volume of hydraulic fluid displaced by the ram 160 in the ram throat 138 causes the piston 120 to move additionally downward. The large cross-sectional area of the top of the ram 160, combined with the smaller cross-sectional area of the bottom of the ram 160, provides the force multiplier effect. The ram 160 presses the hydraulic fluid into the piston chamber 126. The force at the end of the ram 160 in one embodiment is about 6 times the force on the upper side of the ram 160. No additional hydraulic fluid needs to be provided to the actuator 100. The ram 160 therefore provides a large second actuation force over the second (small) stroke span.

It should be understood that the force multiplier can be actuated at any point in the first (large) stroke span. As a result, even if the piston rod 108 is only at a midpoint of the first stroke span, the ram 160 can be moved downward and the second (small) stroke span can be traversed by the piston rod 108, in addition to any portion of the first stroke span already traversed.

The retraction operation is essentially the opposite of the extension operation. For retraction, the pressurized gas at port A and port C is released. Subsequently, pressurized gas is supplied to port B, moving the ram 160 upward to a fully retracted position. The retraction of the ram 160 unblocks the hydraulic fluid passage(s) 137, allowing hydraulic fluid to move from the piston chamber 126 to the ring chamber 147. Then, pressurized gas is introduced to port E in order to force the piston ring 110 fully upward, thereby forcing the piston 120 partially upward (see FIG. 5 and the accompanying discussion below). Pressurized gas is then introduced to port D (while pressure is held at port E), with the pressurized gas at port D pushing the piston 120 fully upward and forcing the movable ring 140 fully downward. Therefore, the second (small) stroke span is retracted first and then the first (large) stroke span is retracted. Optionally, the pressurized gas at port E can then be released, allowing the piston ring 110 to drop down onto the bottom plug 104.

Figure 5:
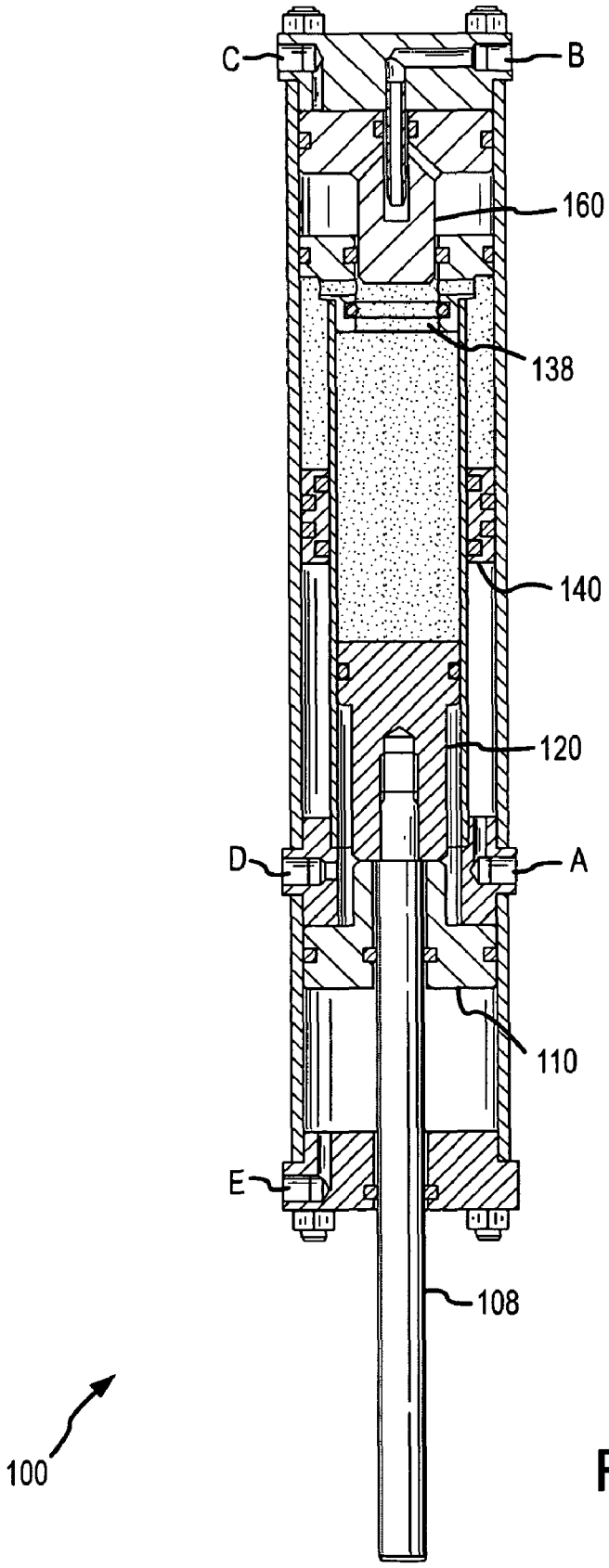
FIG. 5 shows the actuator after the force multiplier has been de-activated.

FIG. 5 shows the actuator 100 after the force multiplier has been de-activated. Here, port C has been released and pressurized gas has been supplied to port B. As a result of the pressurized gas at port B, the ram 160 has been moved upward, unblocking the ram throat 138 and the hydraulic fluid passage(s) 137. Hydraulic fluid can now pass from the piston chamber 126 to the ring chamber 147 via the hydraulic fluid passage(s) 137. In addition, port D remains released and pressurized gas has been supplied at port E. The pressurized gas at port E moves the piston ring 110 upward. The piston ring 110 comes into contact with the piston 120, forcing the piston 120 and the piston rod 108 upward. As a consequence, the piston 120 has moved back upward (i.e., retracted) over the second (small) stroke span, and at least partially over the first (large) stroke span. Consequently, the movable ring 140 has moved partially downward. At this point in the retraction sequence, pressurized gas can be maintained at port E and pressurized gas can now be supplied to port D, wherein the pressurized gas supplied to port D will cause the piston 120 to move fully upward and the piston rod 108 will traverse the large stroke span and fully retract.

The pneumatic pressure coupler according to the invention can be employed according to any of the embodiments in order to provide several advantages, if desired. The invention provides an actuation span including first and second stroke spans, where the first and second stroke spans can be of different lengths. The invention provides an actuation span including first and second actuation speeds. The invention provides an actuation span including first and second actuation forces. The invention provides an actuator including a force multiplier. The invention provides an actuator including a hydro-pneumatic force multiplier. The invention provides an actuator including a force multiplier that can be actuated at any point in a first stroke span.

Advantageously, in the actuator according to the invention, no biasing springs are required. In the actuator according to the invention, no hydraulic fluid is supplied to the actuator. In the actuator according to the invention, force amplification is achieved using only pneumatic inputs.

What is claimed is:

1. A pneumatic actuator (100) comprising an actuator body (102) and a piston rod (108) extending from the actuator body (102), with the piston rod (108) moving over an actuation span, with the pneumatic actuator (100) being characterized by:

a piston ring (110) located in an outer shell (101) and below a piston (120), with the piston ring (110) slidably located in the outer shell (101) and being configured to sealingly slide on the piston rod (108), wherein port E is located below the piston ring (110) and the piston ring (110) moves up and pushes the piston (120) upward when pressurized gas is introduced into port E;

a first stroke span that is traversed by the piston rod (108) at a first actuation speed; and a second stroke span that is traversed at a second actuation speed that is substantially slower than the first actuation speed.

2. The actuator (100) of claim 1, with the second stroke span being substantially smaller in length than the first stroke span.

3. The actuator (100) of claim 1, with the first stroke span being traversed by the piston rod (108) using a first actuation force and with the second stroke span being traversed by the piston rod (108) using a second actuation force that is substantially greater than the first actuation force.

4. The actuator (100) of claim 1, with the second stroke span occurring at any point along the actuation span.

5. The actuator (100) of claim 1, with the second stroke span being generated by a force multiplier of the actuator (100).

6. The actuator (100) of claim 1, further comprising:

an actuator body (102) comprising an outer shell (101) and an inner shell (109);

a piston (120) slidably located in a piston chamber (126) in the inner shell (109);

a ram (160) slidably located in the outer shell (101) and configured to move at least partially into the inner shell (109);

a movable ring (140) slidably located in a ring chamber (147) located between the inner shell (109) and the outer shell (101);

a hydraulic fluid located in a region between the ram (160), the piston (120), and the movable ring (140);

wherein upward movement of the movable ring (140) forces the piston (120) downward over a first stroke span due to movement of a first volume of the hydraulic fluid from the ring chamber (147) into the piston chamber (126); and wherein downward movement of the ram (160) forces a second volume of the hydraulic fluid down into the piston chamber (126), wherein the downward movement of the ram (160) forces the piston (120) downward over a second stroke span.

7. The actuator (100) of claim 6, further comprising a plurality of pneumatic ports in the actuator body (102).

8. The actuator (100) of claim 6, further comprising a port A that introduces pressurized gas into the ring chamber (147) below the movable ring (140).

9. The actuator (100) of claim 6, further comprising a port B that introduces pressurized gas into the ram chamber (161) below the ram (160).

10. The actuator (100) of claim 6, further comprising a port C that introduces pressurized gas into the ram chamber (161) above the ram (160).

11. The actuator (100) of claim 6, further comprising a port D that introduces pressurized gas into the piston chamber (126) below the piston (120).

12. The actuator (100) of claim 6, further comprising one or more hydraulic fluid passages (137) extending between the ram throat 138 and the ring chamber (147).

13. A pneumatic actuator (100) comprising an actuator body (102) and a piston rod (108) extending from the actuator body (102), with the piston rod (108) moving over an actuation span, with the pneumatic actuator (100) being characterized by a piston ring (110) located in an outer shell (101) and below a piston (120), with the piston ring (110) slidably located in the outer shell (101) and being configured to sealingly slide on the piston rod (108), wherein a port E is located below the piston ring (110) and the piston ring (110) moves up and pushes (120) upward when pressurized as is introduced into port E;

a first stroke span that is traversed by the piston rod (108) using a first actuation force; and a second stroke span that is traversed using a second actuation force that is substantially greater than the first actuation force.

14. The actuator (100) of claim 13, with the second stroke span being substantially smaller in length than the first stroke span.

15. The actuator (100) of claim 13, with the first stroke span being traversed by the piston rod (108) at a first actuation speed and with the second stroke span being traversed by the piston rod (108) at a second actuation speed that is substantially slower than the first actuation speed.

16. The actuator (100) of claim 13, with the second stroke span occurring at any point along the actuation span.

17. The actuator (100) of claim 13, with the second stroke span being generated by a force multiplier of the actuator (100).

18. The actuator (100) of claim 13, further comprising:

an actuator body (102) including an outer shell (101) and an inner shell (109);

a piston (120) slidably located in a piston chamber (126) in the inner shell (109);

a ram (160) slidably located in the outer shell (101) and configured to move at least partially into the inner shell (109);

a movable ring (140) slidably located in a ring chamber (147) located between the inner shell (109) and the outer shell (101);

a hydraulic fluid located in a region between the ram (160), the piston (120), and the movable ring (140);

wherein upward movement of the movable ring (140) forces the piston (120) downward over a first stroke span due to movement of a first volume of the hydraulic fluid from the ring chamber (147) into the piston chamber (126); and wherein downward movement of the ram (160) forces a second volume of the hydraulic fluid down into the piston chamber (126), wherein the downward movement of the ram (160) forces the piston (120) downward over a second stroke span.

19. The actuator (100) of claim 18, further comprising a plurality of pneumatic ports in the actuator body (102).

20. The actuator (100) of claim 18, further comprising a port A that introduces pressurized gas into the ring chamber (147) below the movable ring (140).

21. The actuator (100) of claim 18, further comprising a port B that introduces pressurized gas into the ram chamber (161) below the ram (160).

22. The actuator (100) of claim 18, further comprising a port C that introduces pressurized gas into the ram chamber (161) above the ram (160).

23. The actuator (100) of claim 18, further comprising a port D that introduces pressurized gas into the piston chamber (126) below the piston (120).

24. The actuator (100) of claim 18, further comprising one or more hydraulic fluid passages (137) extending between the ram throat (138) and the ring chamber (147).

25. A pneumatic actuator (100), comprising:

an actuator body (102) comprising an outer shell (101) and an inner shell (109);

a piston (120) slidably located in a piston chamber (126) in the inner shell (109);

a ram (160) slidably located in the outer shell (101) and configured to move at least partially into the inner shell (109);

a movable ring (140) slidably located in a ring chamber (147) located be the inner shell (109) and the outer shell (101);

a hydraulic fluid located in a region between the ram (160), the piston (120), and the movable ring (140);

a piston ring (110) located in the outer shell (101) and below the piston (120), with the piston ring (110) slidably located shell (101) and being configured to sealingly slide on the piston rod (108), wherein a port E is located below the piston ring (110) and the piston ring (110) moves up and pushes the piston (120) upward when pressurized gas is introduced into port E;

wherein upward movement, of the movable ring (140) forces the piston (120) downward over a first stroke span due to movement of a first volume of the hydraulic fluid from the ring chamber (147) into the piston chamber (126); and wherein downward movement of the ram (160) forces a second volume of the hydraulic fluid down into the piston chamber (126), wherein the downward movement of the ram (160) forces the piston (120) downward over a second stroke span.

26. The actuator (100) of claim 25, with the first stroke span being traversed by the piston rod (108) using a first actuation force and with the second stroke span being traversed by the piston rod (108) using a second actuation force that is substantially greater than the first actuation force.

27. The actuator (100) of claim 25, with the first stroke span being traversed by the piston rod (108) at a first actuation speed and with the second stroke span being traversed by the piston rod (108) at a second actuation speed that is substantially slower than the first actuation speed.

28. The actuator (100) of claim 25, with the second stroke span occurring at any point along the actuation span.

29. The actuator (100) of claim 25, with the second stroke span being generated by a force multiplier of the actuator (100).

30. The actuator (100) of claim 25, further comprising a plurality of pneumatic ports in the actuator body (102).

31. The actuator (100) of claim 25, further comprising a port A that introduces pressurized gas into the ring chamber (147) below the movable ring (140).

32. The actuator (100) of claim 25, further comprising a port B that introduces pressurized gas into the ram chamber (161) below the ram (160).

33. The actuator (100) of claim 25, further comprising a port C that introduces pressurized gas into the ram chamber (161) above the ram (160).

34. The actuator (100) of claim 25, further comprising a port D that introduces pressurized gas into the piston chamber (126) below the piston (120).

35. The actuator (100) of claim 25, further comprising one or more hydraulic fluid passages (137) extending between the ram throat (138) and the ring chamber (147).

* * * * *